United States Patent [19]

Bender et al.

[11] 4,134,829

[45] Jan. 16, 1979

[54] METHOD AND APPARATUS FOR THE SEPARATION OF MAGNETIZABLE PARTICLES FROM A FINELY-GRANULAR SOLID SUSPENDED IN A CARRIER MEDIUM BY MEANS OF INTENSE FIELD-MAGNET SEPARATION

[75] Inventors: Hans Bender, Leverkusen; Karl-Heinz Unkelbach, Rodenkirchen; Wolf Zabel, Seelscheid, all of Germany

[73] Assignee: Klöckner-Humboldt-Deutz Aktiengesellschaft, Germany

[21] Appl. No.: 730,072

[22] Filed: Oct. 6, 1976

[30] Foreign Application Priority Data

Oct. 11, 1975 [DE] Fed. Rep. of Germany ..... 2545689

[51] Int. Cl.[2] ..... B03C 1/22

[52] U.S. Cl. ..... 209/223 R; 209/229; 209/231

[58] Field of Search ..... 209/214, 223 A, 229, 209/223 R, 232, 213; 210/222, 223, 384, 231, 228

[56] References Cited

U.S. PATENT DOCUMENTS

| | | | |
|---|---|---|---|
| 208,163 | 9/1878 | Pitts | 209/229 X |
| 213,598 | 3/1879 | Wheeler | 209/223 A |
| 233,920 | 11/1880 | Cook | 209/223 R |
| 242,013 | 5/1881 | Martin | 209/229 X |
| 1,625,257 | 4/1927 | Ingolfsrud | 209/223 A |
| 1,692,590 | 11/1928 | Stearns | 209/232 |
| 2,003,430 | 6/1935 | Crockett | 209/232 |
| 2,298,243 | 10/1942 | Widdows | 209/214 |
| 2,428,228 | 9/1947 | Keck | 209/214 X |
| 3,365,599 | 1/1968 | Brzezinski | 210/222 |
| 3,503,504 | 3/1970 | Bannister | 209/232 X |

FOREIGN PATENT DOCUMENTS

| | | | |
|---|---|---|---|
| 834950 | 3/1952 | Fed. Rep. of Germany | 210/384 |
| 546126 | 7/1956 | Italy | 209/213 |

*Primary Examiner*—Robert Halper

*Attorney, Agent, or Firm*—Hill, Gross, Simpson, Van Santen, Steadman, Chiara & Simpson

[57] ABSTRACT

Magnetizable particles are separated from a sludge which includes fine-grained particles and the magnetizable particles suspended in a carrier by creating a laminar flow of the sludge over a surface which is disposed at an angle to the horizontal. The surface is included in a magnetic system which has a plurality of supra-conducting magnets with coils which are energizable to provide alternate north and south poles longitudinally and transversely of the surface. The supra-conducting magnets each have an end adjacent the surface and short-circuited opposite ends to amplify the magnetic force in the direction of the surface. Magnetic particles with greater susceptibility adhere to the surface near the end of the surface which receives the laminar flow and particles with lesser susceptibilities adhere to the surface at respective distances from that end so that the particles are classified with respect to magnetic susceptibility when they are removed by a plurality of scrapers which travel transversely of the surface. Advantageously, the scrapers are formed as an endless belt which carries a plurality of scraper blades.

2 Claims, 5 Drawing Figures

METHOD AND APPARATUS FOR THE SEPARATION OF MAGNETIZABLE PARTICLES FROM A FINELY-GRANULAR SOLID SUSPENDED IN A CARRIER MEDIUM BY MEANS OF INTENSE FIELD-MAGNET SEPARATION

The invention related to an apparatus for the separation of magnetizable particles from a finely granular solid suspended in a carrier medium, said solid being called sludge, — by means of intense field-magnet-separation.

The separation of mixtures of particles with constituents of different magnetizability, which are for example suspended in a liquid as carrier medium, counts as one of the most important types of preparation upon the sorting, separation or concentration of comminuted ores according to the measure of their magnetic susceptibility.

The advantages of this method known as "wet-magnetic-separation" are among others, the possibility of utilization with relatively slight differences in the susceptibility values, higher rate of output referred to similar apparative units of size, as well as the utilization of the most uncomplicated apparatus, which are distinguished to advantage by few mechanically moved parts.

From the German Laid Open Specification No. 2,159,325 there is known a method as well as an apparatus for the separation of magnetizable particles from a finely granular solid with the aid of a magnetic field. According to the same, first the finely granular solid is uniformly prepared with water to a sludge, homogeneously divided over the entire cross-section of the carrier medium channel and conveyed in a channel through the magnetic field. On account of the concentric arrangement of the channel and the annularly-shaped separating dam arranged therein for the portions of material to be separated, necessarily the flow guidance must take place exactly in direction of gravity, accordingly as vertically as possible. In this connection, however, the disadvantage results that indeed magnetizable particles are concentrated away from the center of the flow radially outwardly in direction of the magnetic force on the periphery of the flow-cross-section, that, however, on the other hand, the non-magnetic particles distributed uniformly in the entire flow-cross-section undego no diminishing in their concentration, for which reason, the separation results remain unsatisfactory.

Beyond this, the known apparatus has also still the further disadvantage that stronger magnetizable particles are relatively easily deposited and retained in the interior of the channel wall, — which may lead from undesired influences on the flow through onerous disturbances in the separating process to interruption of the procedure.

A similar disadvantage is revealed also with another known apparatus, namely the magnet arrangement described in the U.S. Pat. No. 3,608,718. In the latter, it is provided, in order to prevent the adherence of magnetizable particles to the wall area of the flow-channel, that the actual stream of material is surrounded concentrically by an annularly shaped flow, a so-called washing fluid or liquid. This measure, however, has on the one hand, only conditioned result, is, however, on the other hand, very detrimental to the output capacity of the magnetic separating system.

Because with the gradient of the magnetic field, the magnetic forces between the poles of a quadrupole according to its center drop to zero, the output capacity of the magnetic separating order diminishes.

It is therefore the object of the invention, to make possible, to the exclusion of all these difficulties and disadvantages of known methods and apparatus, a both qualitatively as well as also quantitatively greater-capacity separation of particles of a finely granular solid according to the extent of its magnetic susceptibility, also in the area of minor differences in susceptibility.

This takes place according to the invention thereby, that the sludge is guided along on the surface of a magnetic system producing a greatly non-homogeneous magnetic field, whereby the charging of the sludge is undertaken in such type and manner, that the latter is spread out into a laminar, thin layer of liquid and flows off uniformly over the magnetic surface, whereby particles which exceed a predetermined magnetic susceptibility, remain adherent within the outlet-points of the magnetic field lines in the area of the surface of the magnetic system, and that finally the adherent particles are removed mechanically from the magnetic system.

This method according to the invention, has the advantage that the magnetic material retained by the magnetic system is at least to a fargoing extent free from barren or sterile material, along with being a concentrate of special quality.

A particularly advantageous embodiment of the method according to the invention is to be seen therein, that the magnetic system extends on an approximately even or plane surface and that the adhering particles are stripped off transversely to the direction of flow of the sludge from the magnetic system. This stripping-off of the adherent particles transversely to the direction of flow of the sludge has among others, the advantage, that the magnetic material may be better separated from the non-magnetic outflow. There results, however, also in this connection a further advantage, because in direction of flow of the sludge, preferably at the charging point, the particles with the greatest susceptibility are deposited, followed by particles with low degree of susceptibility. Upon stripping-off transversely to the direction of flow of the sludge, there is accordingly attained the possibility or recovering separately several magnetic kinds of material of different degree of magnetization.

In further consequent embodiment of this possibility resulting within the scope of the present invention, therefore use may in advantageous manner be made of the measure, that the magnetic force of the magnetic system in direction of the path of flow of the sludge, changes increasingly, that is, from the charging point onto the outflow point. Through this measure, namely, to a special degree, a selective recovery of the magnetic material is attained according to the extent of its different degree of susceptibility.

In the case of a functionally suitable embodiment of the method, it is beyond this provided, that the surface of the magnetic system stands at an angle to the horizontal, and that the sludge in the form of a band or strip of flow thin in relation to the width, taking in the entire width of the surface, is charged at the upper end of the surface.

Such an inclination of the surface of the magnetic surface at an angle to the horizontal is insofar of advantage, because with the change of this angle in relation to the charged quantity of the sludge, both the speed of flow of the stream of sludge over the surface of the magnetic system as well as also — the one dependent on the other — the final thickness of the flow layer may be influenced within wide limits. It is possible in this manner to adapt optimally the operating conditions in the course of the procedure to the particular conditions which arise in accordance with the method, on the one hand from the composition and quantity of the charging material, and on the other hand, from the awaited result.

A particularly favorable modus operandi may in this connection be attained thereby that the sludge is charged at an angle to the surface of the magnetic system. Also, with the setting of this angle, the uniform spreading of the flow of sludge over the surface of the magnetic system may be more or less optimized.

An apparatus for carrying out the method is characterized by one-side magnetic system having a surface for the outlet of the magnetic lines, which is composed of a plurality of individual magnets arranged anti-parallel, as well as by a device for the charging of the sludge, and finally by a device for the mechanical removal of magnetic material adhering to the magnetic system.

An especially effective apparatus is to be furnished thereby, that the magnetic system consists of a number of supraconducting coils producing magnetic fields, and that for the amplification of the magnetic force in direction to a preferred surface of the magnetic system, in a manner known per se, the ends of the coils opposite to this surface are short-circuited with a ferromagnetic material.

Hereby, it is suitable within the sense of the further advantageous utilization of the method described above, that the surface of the magnetic system is arranged in or at an inclination changeable with respect to the horizontal — in direction of flow of the sludge. As already mentioned, this changeability in the inclination serves for the finding and adjustment of optimal conditions of operation for a predetermined case of preparation.

A further advantageous embodiment of the apparatus according to the invention provides additionally that the device for the mechanical removal of adherent magnetic material is an endless band equipped with strippers transversely to the direction of rotation, revolving between a driving- and a guide roller, said band being so arranged with relation to the magnetic system, that the strippers extend approximately transversely to the direction of flow of the sludge over the surface of the magnetic system.

Use may, however, also be made of the measure that the device for the mechanical removal of adherent magnetic material consists of a thin-walled band of non-magnetic material extending over the magnet surface transversely to the direction of the flow of the sludge, said band being moved between the flow of sludge and the magnet surface in charging direction of the magnetic material.

The constructive possibilities for the development of a device operating suitably for the mechanical removal of adherent magnetic material are, however, not yet created with these preferred examples of embodiments. Rather, it is imaginable that such a stripping apparatus, for example is equipped with a reciprocatingly moved wiper, which for example is set into reciprocating motion by means of a linkage-parallelogram or a crank-mechanism-drive which strips off and removes magnetic material to one or both sides of the magnetic system — approximately transversely to the direction of flow of the sludge. Further details and features of the invention will result from the following explanation of the drawings, in which examples of arrangements of the magnetic separating apparatus according to the invention are shown.

Figure 1:
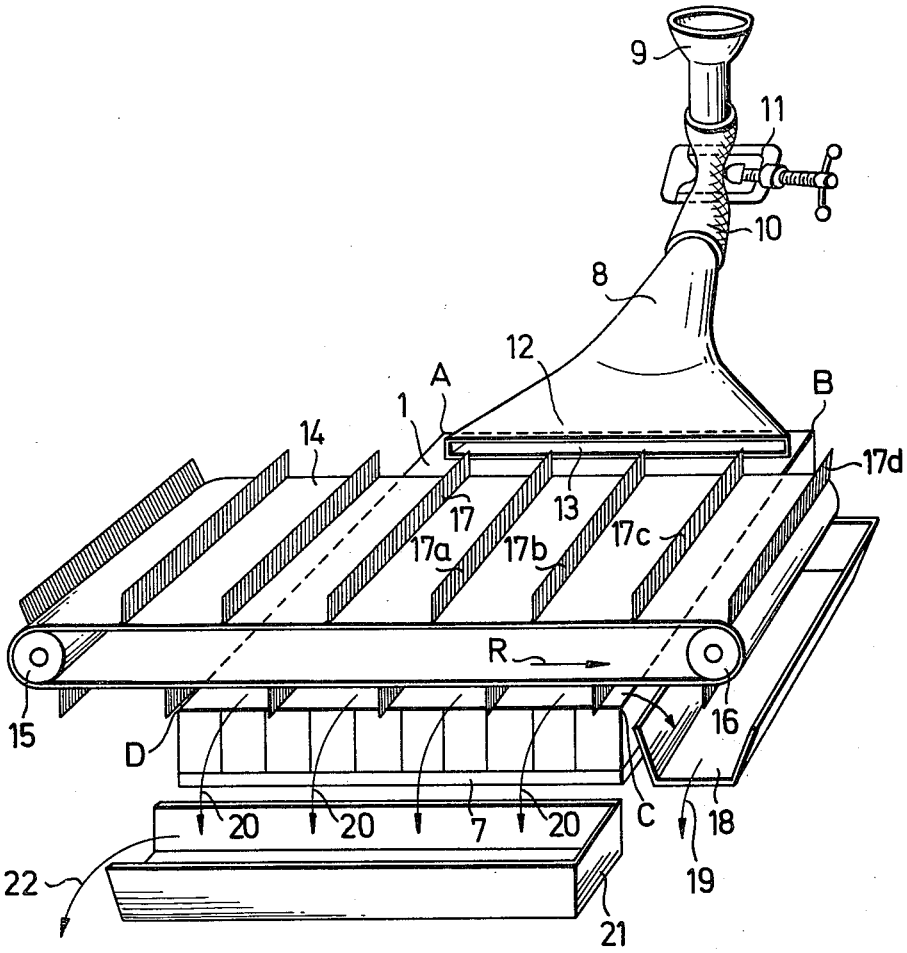
FIG. 1 shows a magnetic separator according to the invention, in perspective showing.
Figure 5:
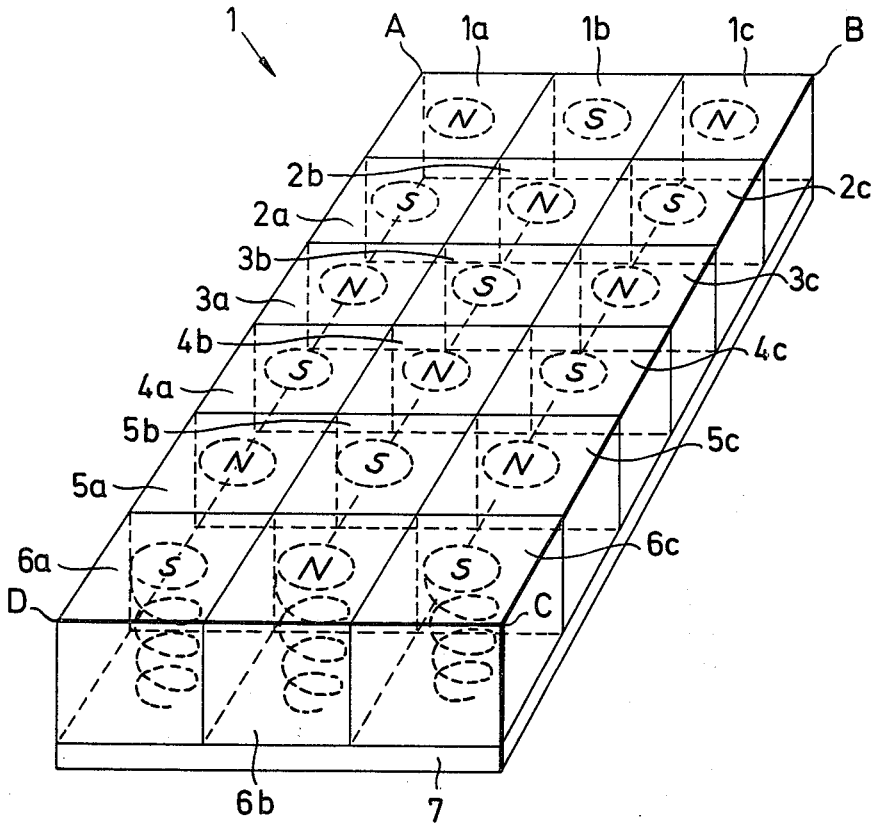
FIG. 5 shows likewise in perspective, the magnetic system in detail, consisting of a plurality of anti-parallel arranged individual magnets.

FIG. 1 shows in detail a magnetic system 1 whose surface extends between the corner points A, B, C, D. This magnetic system 1, as apparent from the detailed showing in FIG. 5, is further composed of a plurality of anti-parallel arranged individual magnets 1*a*, 1*b*, 1*c*; 2*a*, 2*b*, 2*c*; 3*a*, 3*b*, 3*c*; 4*a*, 4*b*, 4*c*; 5*a*, 5*b*, 5*c*; 6*a*, 6*b*, 6*c*; It is a question in the example shown, of so-called supraconducting coils. Through the anti-parallel arrangement, it is attained, that the magnetic poles from magnet to the adjacent magnet, as shown in FIG. 5, are directed oppositely in each case, accordingly, North - South - North - South - North - South, etc., as indicated in FIG. 5 — N-S-N-S etc. For the amplification of the magnetic force in direction of the preferred surface of the magnetic system between the corner points A B C D, the ends of the coils opposite this surface are short-circuited with a ferromagnetic plate 7, There is further seen in FIG. 1 the charging device 8 for the sludge, consisting of the inlet funnel 9, the flexible connecting pipe 10 with the pipe-snap-valve 11 as well as the inlet-spout 12 with the outlet-mouthpiece 13. There is seen further a device for the mechanical removal of adherent magnetic material in form of an endless band 14 which rotates between the driving roller 15 and the guide roller 16. This band 14 is equipped transversely to the direction of rotation, which is indicated by the arrow R, with actuators 17, 17*a*, 17*b*, 17*c*, 17*d*, etc. These latter pass over the surface of the magnetic system 1 from the line A–D to the line D–C and wipe thereby the adherent material away from this surface into the charging channel 18, from which the collected concentrated magnetic material shown by the arrow 19, flows off. The non-magnetic waste or outflow travels, as indicated by the arrow 20, into the collecting channel 21 and is conveyed off, as indicated by the further arrow 22.

Figure 2:
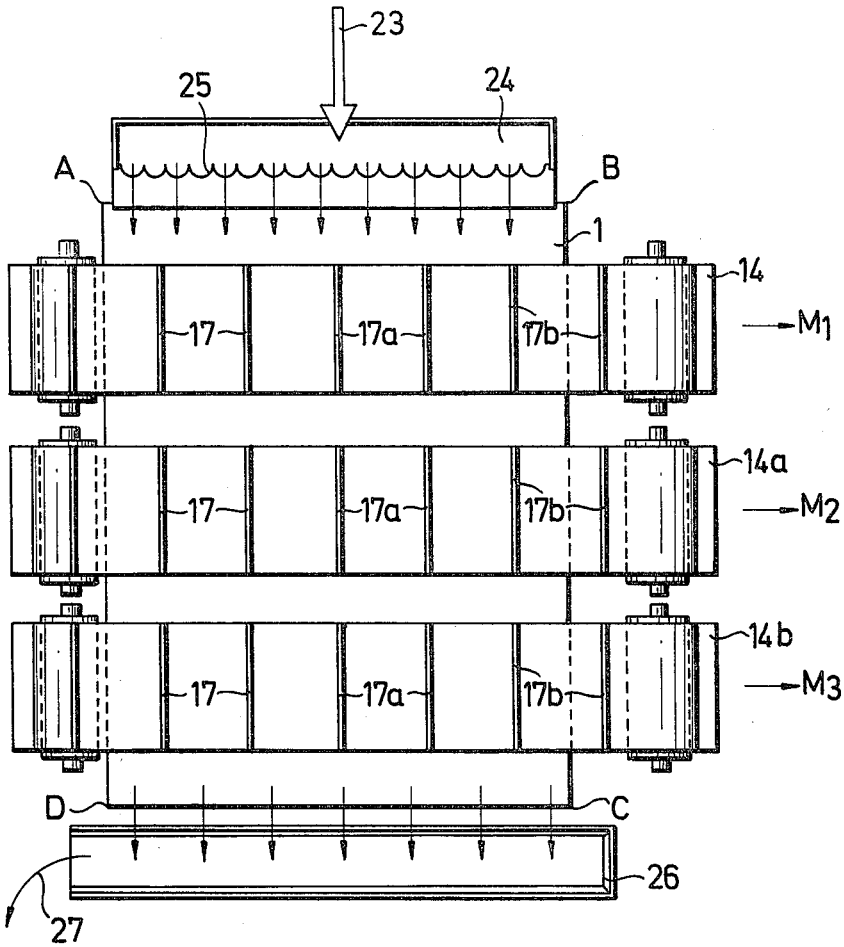
FIG. 2 shows the special arrangement of a magnetic separator according to the invention, in which the magnetic system has in direction of flow of the sludge an increase in the magnetic forces, and for the discharge of magnetic material with different degree of susceptibility, several parallel-arranged stripping apparatus are provided, this arrangement being shown in plan view.

In FIG. 2 may be seen in plan view a similar magnetic system 1, whose surface likewise extends between the corner points A B C D. Not recognizable from the plan view, however, mentioned as prerequisite for the better explanation of the functioning, the magnetic surface is to possess an inclination with respect to the horizontal, whereby the corner points A–B — at the same level — are laid higher than the corner points C–D located likewise at the same level. Thereby it results that there is from the line A–B of the magnetic system 1 to the line C–D a drop or inclination for the sludge, which — indicated by the arrow 23 — through the channel 24, equipped with a notched dam 25 is charged uniformly on the surface of the magnetic system 1 shortly below the line A–B. In the present case, the magnetic system 1 possesses a magnetic force from the line A–B in direction to the line C–D increasing stepwise or gradually with the path of flow of the sludge. This increase in the magnetic force may for example be attained thereby, that, considering once more the magnetic system according to FIG. 5, for example the number of windings of the individual coils of 1*a*, 1*b*, 1*c* to 6*a*, 6*b*, 6*c* corresponding with the desired amplification of the field lines, are increasingly multiplied. Correspondingly, there are arranged above the magnetic system 1 three stripper bands 14, 14*a*, 14*b* parallel to one another. Arrangement and functioning correspond further to the stripping arrangement of the band 14 in FIG. 1. All these bands 14, 14*a*, 14*b* are accordingly equipped with strippers 17, 17*a*, 17*b*, etc.

In this manner, the magnetic apparatus according to FIG. 2, is in position to discharge at the arrow M 1 the strongly magnetic material, at the arrow M 2 a medium material, and at the arrow M3 a weakly magnetic material, while the non-magnetic material flows off at the line C–D is collected in a collection channel 26 and is conveyed off as waste at the arrow 27.

Figure 3:
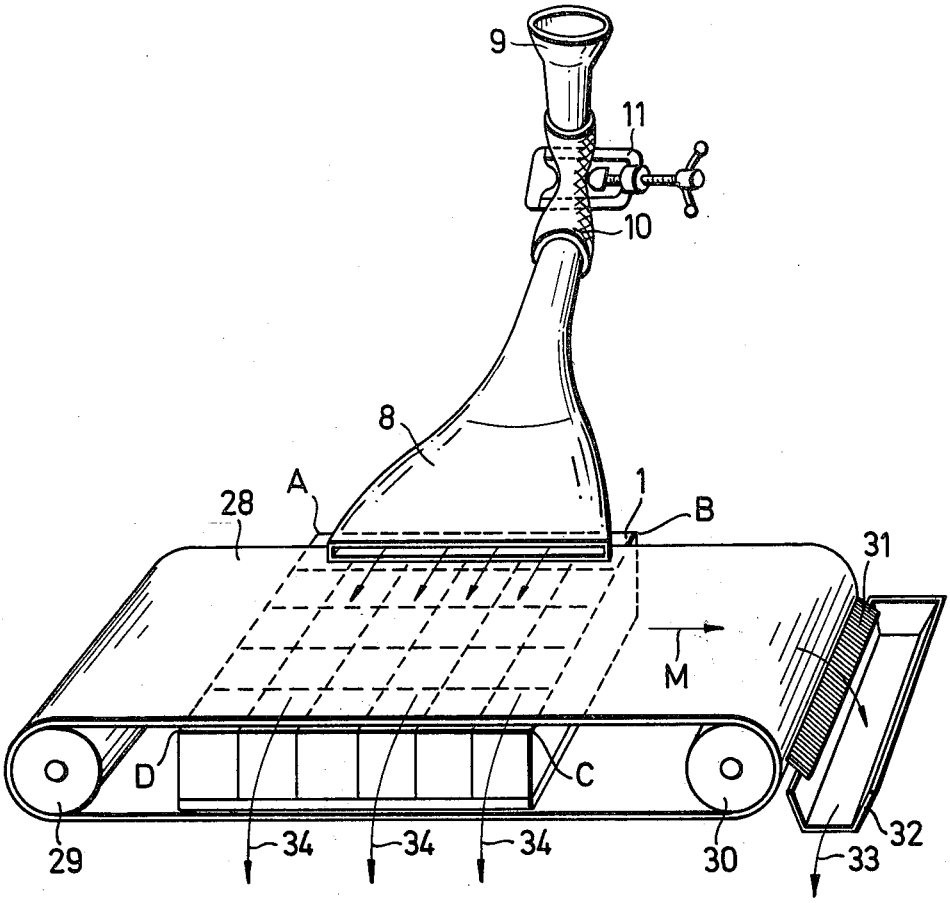
FIG. 3 shows another arrangement of the magnetic separator according to the invention, with a thin-walled band of non-magnetic material moved transversely to the direction of flow of the sludge over the magnet surface, for the mechanical removal of adherent magnetic material, this arrangement being in perspective dhowing.

FIG. 3 shows a further alternative, likewise with the magnetic system 1 as well as a sludge charging apparatus 8, which corresponds to the corresponding apparatus in FIG. 1, as far as functioning is concerned. In this embodiment of the invention, the device for the mechanical removal of adherent magnetic material consists of an endless band 28 drawn over the magnetic surface A B C D. The latter travels over the driving roller 29 and the guide-roller 30. On the band 28 is arranged in a manner known per se, a stationary stripper 31, which strips off the adherent magnetic material and discharged from the band in direction of the arrow M into the collection channel 32, from which the concentrate flows off, shown by the arrow 33. The non-magnetic material flows, indicated by the arrow 34, into a collector channel, not shown in greater detail.

Figure 4:
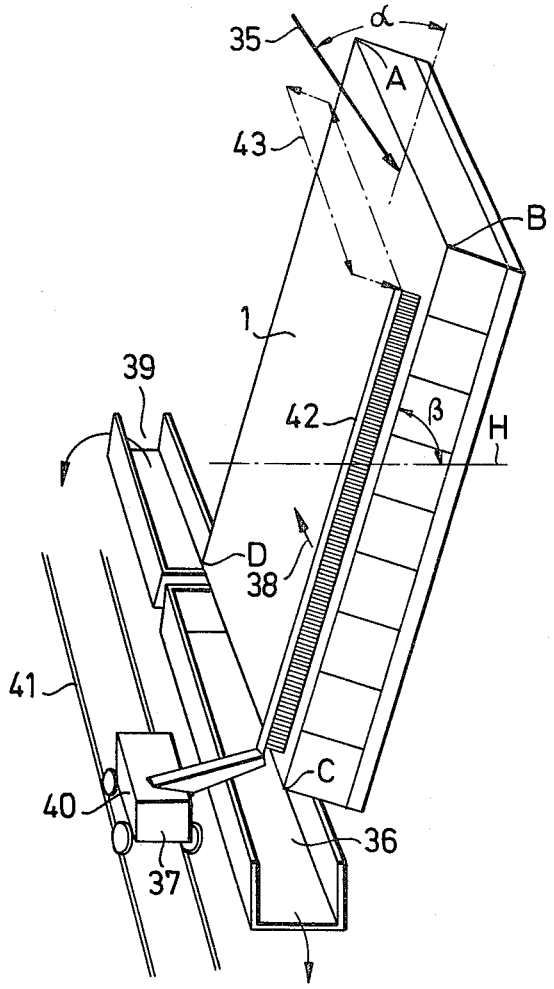
FIG. 4 shows as further embodiment by way of example of the apparatus according to the invention, a magnetic system standing approximately perpendicularly to the horizontal with a reciprocating device equipped with a wiper for the mechanical removal of the magnetic material, this being shown in perspective.

FIG. 4 finally shows a further alternative embodiment of the magnetic separating apparatus according to the invention. Hereby the magnetic system stands approximately perpendicularly to the horizontal H. The charging of the sludge takes place at the upper end, shown by the arrow 35 at the angle $\alpha$ to the surface A B C D of the magnetic system 1. While the non-magnetic material flows off unhindered over this surface A B C D into the collector channel 36, magnetic material is retained in the area of the surface. A stripping apparatus 37 strips the material periodically in direction of the arrow 38 into the collector channel 39. To this end, this stripping apparatus 37 consists of a driving apparatus 40 which moves to and fro on rails 41, whereby the stripper 42 abuts in direction of the arrow 38 on the surface A B C D, while it is raised upon backward movement. This movement is further clearly shown by the arrow-parallelogram 43.

The examples of embodiments shown continue still in a great number of constructive alternatives, whereby, however, in each case the same functional fundamentals are accomplished. Thereby all the same or similar apparatus fall under the invention, insofar as they satisfy one of the following patent claims.

We claim:

1. Apparatus for the separation of magnetizable particles from fine-grained particles of solids suspended in a carrier medium to form a sludge, comprising:

a magnetic system including a surface and a plurality of supra-conducting magnets providing alternate north and south poles longitudinally and transversely of said surface, said supra-conducting magnets each having one end adjacent said surface and short circuited opposite ends to amplify the magnetic force in the direction of said surface, said surface disposed at an angle to the horizontal, said magnets including coils energized to provide magnetic forces which increase from one end of said surface toward the other end of said surface;

charging means for creating a laminar flow of the sludge over said surface from said one end toward the other end so that magnetic particles having a greater susceptibility adhere to said surface nearer said one end and magnetic particles with lesser susceptibilities adhering to said surface at respective distances from said one end toward said other end; and removal means for mechanically removing the adherent particles from said surface, said removal means including a plurality of scrapers spaced apart in the direction of sludge flow and movable over said surface transversely of the direction of sludge flow to scrape respective particles of different magnetic susceptibility from said surface, respectively.

2. The apparatus of claim 1, wherein:

each of said scrapers comprises an endless belt moving transversely of said surface, said belt carrying a plurality of spaced apart scraper blades for scraping across said surface.

* * * * *